US006916225B2

(12) United States Patent
Sugiyama et al.

(10) Patent No.: US 6,916,225 B2
(45) Date of Patent: Jul. 12, 2005

(54) MONITOR, METHOD OF MONITORING, POLISHING DEVICE, AND METHOD OF MANUFACTURING SEMICONDUCTOR WAFER

(75) Inventors: Yoshikazu Sugiyama, Yokohama (JP); Yasushi Ohuchi, Kawasaki (JP)

(73) Assignee: Nikon Corporation, Tokyo (JP)

( * ) Notice: Subject to any disclaimer, the term of this patent is extended or adjusted under 35 U.S.C. 154(b) by 267 days.

(21) Appl. No.: 10/181,805

(22) PCT Filed: Dec. 19, 2000

(86) PCT No.: PCT/JP00/08992

§ 371 (c)(1),
(2), (4) Date: Jul. 23, 2002

(87) PCT Pub. No.: WO01/56068

PCT Pub. Date: Aug. 2, 2001

(65) Prior Publication Data

US 2003/0020009 A1 Jan. 30, 2003

(30) Foreign Application Priority Data

Jan. 25, 2000 (JP) ..... 2000-015365
Nov. 21, 2000 (JP) ..... 2000-354603

(51) Int. Cl.[7] ..... B24B 1/00

(52) U.S. Cl. ..... 451/6; 451/5; 451/41; 451/285; 451/287

(58) Field of Search ..... 451/6, 8, 41, 5, 451/285, 287; 340/680; 356/630, 631, 632; 250/559.27, 559.28

(56) References Cited

U.S. PATENT DOCUMENTS 5,433,651 A 7/1995 Lustig et al. ..... 451/6
5,483,280 A * 1/1996 Takahashi et al. ..... 348/296
6,142,855 A * 11/2000 Nyui et al. ..... 451/67
6,146,242 A * 11/2000 Treur et al. ..... 451/6
6,271,921 B1 * 8/2001 Maris et al. ..... 356/432
6,441,905 B1 * 8/2002 Tojyo et al. ..... 356/429

FOREIGN PATENT DOCUMENTS

| | | |
|---|---|---|
| EP | 0882 550 | 12/1998 |
| JP | 58-007115 | 1/1983 |
| JP | 2-86128 U | 7/1990 |
| JP | 11-151663 | 6/1999 |
| JP | 2001-9699 | 1/2001 |
| JP | 2001-88021 | 4/2001 |
| WO | WO 95/18353 | 7/1995 |

* cited by examiner

*Primary Examiner*—George Nguyen
(74) *Attorney, Agent, or Firm*—Morgan, Lewis & Bockius LLP

(57) ABSTRACT

The end portion on the side of the second end surface of the first optical fiber 62 is inserted into the inner race in the central part of the roll-bearing type bearing 36, and is fastened to this inner race. The fastening position of this end surface on the side of the second end surface is adjusted to match a specified position on the axis of rotation 11 in order to emit probe light and allow the incidence of the reflected signal light. The probe light emitted from the second end surface of the second optical fiber 61 passes through the transparent window 23 and is caused to illuminate the polished surface of the substrate 42. The reflected signal light that is reflected from this point again passes through the transparent window 23 in the opposite direction, and is incident on the second end surface of the second optical fiber 61. Thus, even in cases where monitoring is performed in an operating state in which the polishing surface plate of the polishing apparatus is rotating, the first optical fiber 62 can be kept in a non-rotating state; as a result, the light source 24, beam splitter 25, light detector 26 and first light-coupling lens 63, which require installation space, can be installed in non-rotating positions.

15 Claims, 10 Drawing Sheets

MONITOR, METHOD OF MONITORING, POLISHING DEVICE, AND METHOD OF MANUFACTURING SEMICONDUCTOR WAFER

TECHNICAL FIELD

The present invention relates to a monitoring device and monitoring method for monitoring the polishing conditions during the polishing of substrates, especially semiconductor wafers on which semiconductor elements are formed in a semiconductor manufacturing process, and also relates to a polishing apparatus into which this monitoring device is incorporated, and a semiconductor wafer manufacturing method.

BACKGROUND ART

With the unlimited increase in the integration of semiconductor integrated circuits, semiconductor process techniques for the manufacture of such circuits have become increasingly finer, and have burst into the quarter-micron age from the sub-half-micron age. As a result, the numerical aperture (NA) of exposure apparatuses used in photolithographic exposure processes has increased, and as a result, the focal depth of such exposure apparatuses has become increasingly shallow. Furthermore, there has also been an increased tendency toward three-dimensionalization of device structures, the formation of multi-layer structures in electrode wiring, and increased complexity of such structures.

In recent years, CMP (chemical-mechanical polishing or chemical-mechanical planarization), which is a global flattening technique for inter-layer insulating films in semiconductor processes, has attracted attention as an important technique for dealing with such trends. In the substrate polishing apparatus used in this CMP process, as is indicated by 1 in FIG. 11, a substrate (semiconductor wafer) 107 which is mounted in a substrate holding part 102 is caused to undergo relative motion while being pressed against a polishing pad 103 that is fastened to a polishing surface plate 104, and the surface of the substrate is globally polished by the chemical polishing action and mechanical polishing action of a polishing agent (slurry) 105 that is supplied from a polishing agent supply mechanism 106.

Measurement of the residual film thickness in polishing and ascertainment of the endpoint of the process are among the most important performance requirements in such a substrate polishing apparatus. The precision of this measurement greatly influences the quality of the semiconductor elements that are manufactured by means of this apparatus, and therefore the quality of the integrated circuits.

However, conventional substrate polishing apparatuses are all on an extension of existing apparatuses, and cannot currently satisfy requirements for an increased degree of working precision. Especially in regard to variation in the residual film thickness between lots, fluctuating factors in the amount of polishing per unit time (polishing rate), e.g., various factors that fluctuate on an occasional basis such as the polishing pressure, amount of polishing agent supplied and temperature environment of the substrate, etc., in addition to clogging of polishing pad, cannot be handled in the case of control methods that depend on the setting of the working time.

Furthermore, methods have also been used in which the residual film thickness following working is measured by means of a special measuring device (ellipsometer, etc.), and the residual film thickness is controlled by feeding this information back into the substrate polishing apparatus. However, this method suffers from a drawback in that the polishing work must be temporarily stopped in order to perform measurements. Furthermore, even if an accurate residual film thickness value is obtained for the polished substrate by such measurements, the measurements are performed intermittently; as a result, under conditions in which the above-mentioned fluctuating factors are present, accurate ascertainment of the endpoint of the process is impossible. Accordingly, the object of accurately obtaining the target residual film thickness cannot be achieved, and variation in the film thickness between lots cannot be ignored.

In the past, therefore, besides methods in which the polishing endpoint is detected by time control, detection methods that utilize fluctuations in the torque of the motor that drives the polishing surface plate have been proposed as detection methods for detecting the polishing endpoint at the same time that polishing is performed (i.e., in-situ). Such methods utilize the fact that the polishing resistance varies when the material of the polished surface of the substrate varies at the polishing endpoint. Fluctuations in the polishing resistance are detected by monitoring the motor torque, and the polishing endpoint is detected from variations in the motor torque.

However, although detection methods that utilize fluctuations in the motor torque are effective in cases where a variation in the material occurs at the polishing endpoint (e.g., in cases where the underlying silicon is exposed in the process of polishing an oxide film), such methods are insufficient in terms of precision in cases where it is desired to flatten irregularities in the surface of the same film consisting of the same material throughout with high precision (approximately ±100 nm or better). Furthermore, since no conspicuous fluctuation in the motor torque appears at the polishing endpoint in such cases, detection of the polishing endpoint is virtually impossible.

Recently, therefore, the development of endpoint detection based on an optical system has been pursued instead of endpoint detection from such torque fluctuations.

A powerful example of such an optical endpoint detection technique is shown in FIG. 12. In FIG. 12, the polishing apparatus 1 produces a relative motion by the rotary motion 100 of the substrate and the rotary motion 101 of the polishing pad while pressing the substrate (semiconductor wafer) 107 which is mounted on a substrate holding part 102 against the polishing pad 103, which is fastened to a polishing surface plate 104, and the surface of the substrate is globally polished by the chemical polishing action and mechanical polishing action of a polishing agent (slurry) 105 that is supplied from a polishing agent supply mechanism 106.

In this technique, probe light emitted from a monitoring apparatus 109 is caused to illuminate the semiconductor wafer 107 via transparent windows 110 formed in the polishing pad 103 and polishing surface plate 104, and ascertainment of the process endpoint is accomplished by the reception of reflected light from the semiconductor wafer 107 by a photo-detection device with which the monitoring device is equipped.

However, in regard to such an endpoint detection method, only the scope of the method in terms of the principle of the method has been disclosed; there has been no clear disclosure regarding the disposition of constituent members such as the concrete optical system. For example, the technique described in Japanese Patent Application Kokai No. H9-36072 may be cited as an example of a technique that is close to the technique shown in FIG. 12; however, there is no description of the construction of the optical sensor in this patent.

Furthermore, as is seen from FIG. 12, the monitoring device 109 must be fastened to the rotating polishing surface plate 104. Since the monitoring device is equipped with a light source and a photo-detector, an accommodating space of a size that cannot be ignored is required in the lower part of the polishing surface plate 104 in order to accommodate this monitoring device in cases where the monitoring device rotates. This greatly restricts the design of the CMP polishing apparatus.

Generally, in the case of equipment such as a CMP polishing apparatus that is operated inside an expensive clean room, there is an especially strong demand for reduction in the size and weight of the apparatus. Thus, such an increase in the accommodating space not only reduces the degree of freedom in design, but is also a major obstacle to size and weight reduction of the CMP polishing apparatus.

DISCLOSURE OF THE INVENTION

One object of the present invention is to solve the above-mentioned problems, and to provide a monitoring device and monitoring method that make it possible to measure the residual film thickness with a high degree of precision, and to detect the process endpoint by optical means, regardless of the actual material of the substrate.

Another object of the present invention is to provide a compact, light-weight polishing apparatus which is equipped with this monitoring device and which is capable of high-precision polishing.

Still another object of the present invention is to provide a method for polishing and manufacturing semiconductor wafers with a high degree of precision using this polishing apparatus.

The first invention that is used in order to achieve the above-mentioned objects is a monitoring device which is equipped with a polishing body part that has a rotatable polishing body with a working surface, and a substrate holding part that holds a substrate, and which monitors the polishing conditions by means of a reflected signal light obtained by illuminating the polished surface of the above-mentioned substrate with probe light when this polished surface is polished by interposing a polishing agent between the above-mentioned rotating working surface and this polished surface, and producing a relative motion between these two parts, this monitoring device being characterized by the fact that the device is equipped with a non-rotating light source which emits the above-mentioned probe light, a non-rotating light detector which receives the above-mentioned reflected signal light, and a turnabout optical part which emits the above-mentioned reflected signal light from a specified position on the axis of rotation of the above-mentioned polishing body part when the above-mentioned probe light is incident on this specified position, and which is incorporated into the above-mentioned polishing body part, so that this optical part can rotate together with the above-mentioned polishing body.

Here, the term "polishing body part" refers not only to the polishing body, polishing surface plate and shaft, but also to the mechanical system equipped with a rotating mechanism, etc.

The second invention that is used in order to achieve the above-mentioned objects is the above-mentioned first invention which is further characterized by the fact that the above-mentioned turnabout optical part is equipped with a light-coupling lens and a second optical fiber with a refractive index of $n_0$, and the above-mentioned monitoring device is further equipped with a non-rotating first optical fiber.

The third invention that is used in order to achieve the above-mentioned objects is the above-mentioned first invention which is further characterized by the fact that the above-mentioned monitoring device is equipped with a non-rotating first reflective mirror, and the above-mentioned turnabout optical part is equipped with a second reflective mirror and a third reflective mirror.

The fourth invention that is used in order to achieve the above-mentioned objects is any of the above-mentioned first through third inventions which is further characterized by the fact that the above-mentioned turnabout optical part is equipped with a transparent window having a refractive index of $n_1$ which transmits the above-mentioned probe light toward the above-mentioned polished surface, and which transmits the above-mentioned reflected signal light in the opposite direction.

The fifth invention that is used in order to achieve the above-mentioned objects is the above-mentioned fourth invention which is further characterized by the fact that the end portion of the above-mentioned second optical fiber and the above-mentioned transparent window are bonded by an adhesive agent with a refractive index whose difference from $n_0$ is ±17% or less, and whose difference from $n_1$ is ±17% or less.

The sixth invention that is used in order to achieve the above-mentioned objects is the above-mentioned fourth invention which is further characterized by the fact that the end portion of the above-mentioned second optical fiber and the above-mentioned transparent window are bonded by an adhesive agent with a refractive index whose difference from $n_0$ is ±17% or less, and an anti-reflection film which is used to reduce interfacial reflection between the above-mentioned adhesive agent and the above-mentioned transparent window is formed on at least the bonded portion of the above-mentioned transparent window.

The seventh invention that is used in order to achieve the above-mentioned objects is the above-mentioned fourth invention which is further characterized by the fact that the above-mentioned turnabout optical part is further equipped with an optical system which is installed between the above-mentioned transparent window and the end surface of the above-mentioned second optical fiber, and which has a convex power that is used to illuminate the above-mentioned polished surface with probe light that is emitted from the above-mentioned end surface of the above-mentioned second optical fiber, and to focus the reflected signal light on the above-mentioned end surface of the above-mentioned second optical fiber.

The eighth invention that is used in order to achieve the above-mentioned objects is the above-mentioned fourth invention which is further characterized by the fact that the above-mentioned turnabout optical part is further equipped with an optical system which is installed between the above-mentioned transparent window and the above-mentioned third reflective mirror, and which has a convex power that is used to illuminate the above-mentioned polished surface with probe light that is emitted from the above-mentioned third reflective mirror, and to relay the reflected signal light to the above-mentioned third reflective mirror.

The ninth invention that is used in order to achieve the above-mentioned objects is the above-mentioned seventh invention which is further characterized by the fact that a lens with a refractive index of $n_2$ which is located closest to the above-mentioned end surface of the above-mentioned second optical fiber in the above-mentioned optical system and the above-mentioned end surface of the above-mentioned second optical fiber are bonded by an adhesive agent with a refractive index whose difference from $n_0$ is ±17% or less, and whose difference from $n_2$ is ±17% or less.

The tenth invention that is used in order to achieve the above-mentioned objects is the above-mentioned seventh invention which is further characterized by the fact that a lens with a refractive index of $n_2$ which is located closest to the above-mentioned end surface of the above-mentioned second optical fiber in the above-mentioned optical system and the above-mentioned end surface of the above-mentioned second optical fiber are bonded by an adhesive agent with a refractive index whose difference from $n_0$ is ±17% or less, and an anti-reflection film which is used to reduce interfacial reflection between the above-mentioned adhesive agent and the above-mentioned lens with a refractive index of $n_2$ is formed on at least the bonded portion of the above-mentioned lens with a refractive index of $n_2$.

The eleventh invention that is used in order to achieve the above-mentioned objects is any of the above-mentioned seventh through tenth inventions which is further characterized by the fact that the above-mentioned optical system is equipped with a n iris in a position that is optically conjugate with the above-mentioned polished surface.

The twelfth invention that is used in order to achieve the above-mentioned objects is any of the above-mentioned second, fourth through seventh or ninth through eleventh inventions which is further characterized by the fact that the normal direction of at least one end surface of the above-mentioned first or second optical fiber is set so that this normal direction is not parallel to the direction of the optical axis of the above-mentioned first or second optical fiber.

The thirteenth invention that is used in order to achieve the above-mentioned objects is any of the above-mentioned second, fourth through seventh or ninth through twelfth inventions which is further characterized by the fact that at least the above-mentioned first or second optical fiber, or both optical fibers, are optical fibers equipped with a core that consists of a liquid.

The fourteenth invention that is used in order to achieve the above-mentioned objects is a monitoring method which monitors the polishing state by means of a reflected signal light obtained by illuminating the polished surface of a substrate with probe light when this polished surface is polished by interposing a polishing agent between a rotating working surface and this polished surface, and producing a relative motion between these two parts, this monitoring method being characterized by the fact that the method includes a step in which probe light is emitted from a non-rotating light source, a step in which the above-mentioned probe light is caused to be incident on a turnabout optical part which rotates together with the above-mentioned working surface, and a step in which the reflected signal light emitted from the above-mentioned turnabout optical part is received by a non-rotating light detector.

The fifteenth invention that is used in order to achieve the above-mentioned objects is a polishing apparatus which is characterized by the fact that this apparatus is equipped with the monitoring device of any of the above-mentioned first through thirteenth inventions.

The sixteenth invention that is used in order to achieve the above-mentioned objects is a semiconductor wafer manufacturing method which is characterized by the fact that the above-mentioned substrate is a semiconductor wafer on which a semiconductor element is formed, and this method includes a step in which the surface of a substrate is polished using the polishing apparatus of the fifteenth invention.

In the monitoring device of the present invention, only the compact turnabout optical part, i.e., the objective part, is installed on the side of the rotating polishing body of the polishing apparatus. The light source, light detector, beam splitter and spectroscope (in the case of a spectroscopic method), i.e., the measuring parts (which require a relatively large amount of installation space), are installed in non-rotating positions. Accordingly, the degree of freedom in the design of a polishing apparatus equipped with this monitoring device is increased, and the size and weight of the apparatus can be reduced. Furthermore, the polishing conditions can be monitored with a high degree of precision.

Furthermore, the monitoring method of the present invention makes it possible not only to monitor the polishing conditions with a high degree of precision, but also to increase the degree of freedom in the design of the polishing apparatus, and to make the polishing apparatus more compact. Moreover, the polishing apparatus of the present invention is not only compact, but allows monitoring of the polishing conditions with a high degree of precision.

Furthermore, in the polishing method of the present invention, since the polishing conditions are monitored with a high degree of precision, the quality and yield of substrates such as semiconductor elements that are polished can be greatly improved.

BEST MODE FOR CARRYING OUT THE INVENTION

Below, in order to describe the present invention in greater detail, preferred working configurations of the present invention will be described with reference to the attached figures. However, it goes without saying that the contents of these working configurations do not limit the scope of the present invention.

[First Working Configuration]

Figure 1:
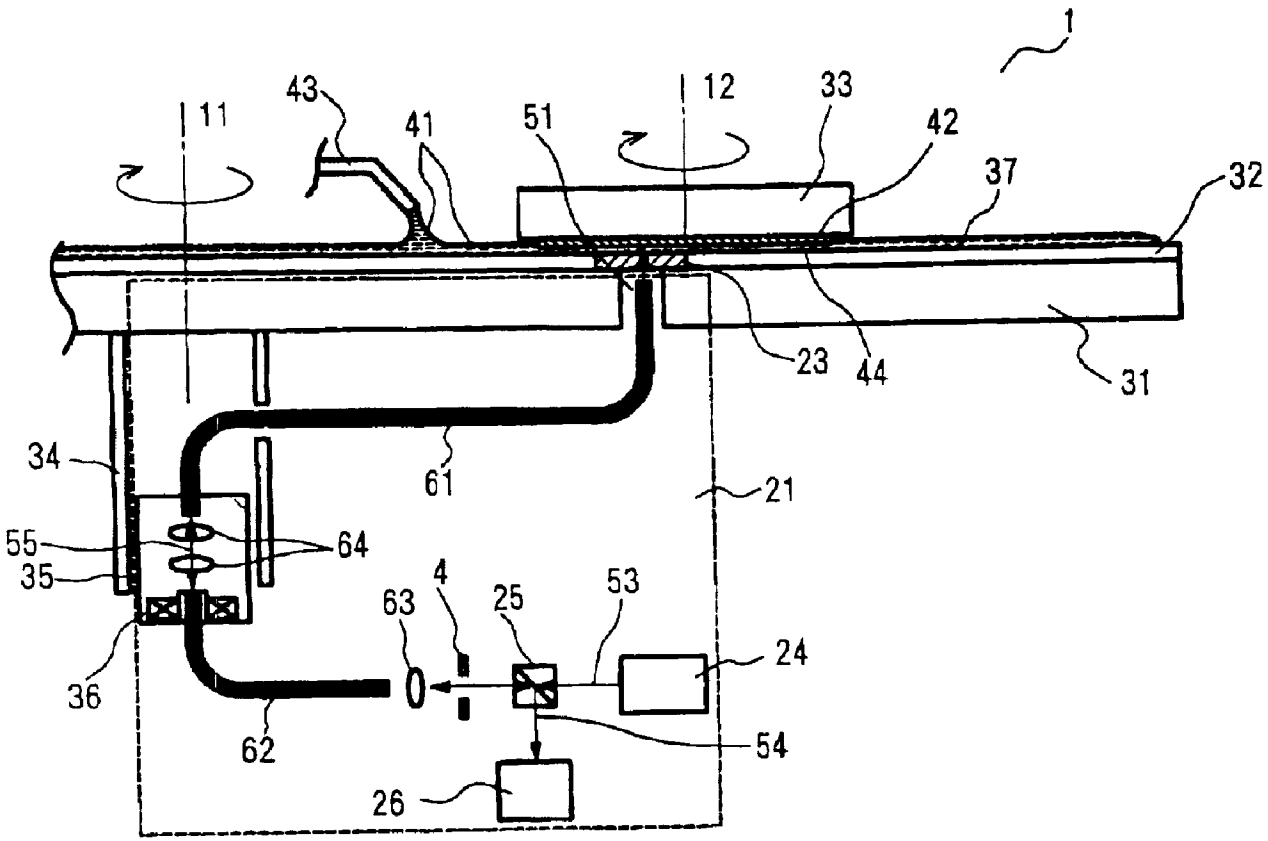
FIG. 1 is a schematic diagram of a monitoring device and polishing apparatus constituting a first working configuration of the present invention.

FIG. 1 shows a schematic diagram of a polishing apparatus incorporating a monitoring device that constitutes a working configuration of the present invention. In FIG. 1, 21 indicates the monitoring device, which is equipped with a light source 24 that emits probe light, a beam splitter 25, a light detector 26 that receives the reflected signal light, a first light-coupling lens 63, a first optical fiber 62, a rotary joint 35 and a second optical fiber 61. The rotary joint 35 is equipped with a second light-coupling lens 64, a bearing 36, and a fastening seat used to fasten the first end surface of the second optical fiber 61.

The end portion on the side of the second end surface of the first optical fiber 62 is inserted into the inner race in the central part of the roll-bearing type bearing 36, and is fastened to this inner race. The fastening position of this end surface on the side of the second end surface is adjusted to match a specified position on the axis of rotation 11 in order to emit probe light and allow the incidence of the reflected signal light. Furthermore, the end portion on the side of the first end surface of the second optical fiber 61 is fastened to the fastening seat. The outer race of the bearing 36 is fastened to the housing part of the rotary joint 35, and the housing part of the rotary joint 35 is fastened to the inside surface of a shaft 34. As a result of the formation of such a structure, a state can be obtained in which the second optical fiber 61 rotates together with the polishing surface plate 31, and the first optical fiber 62 is fixed and does not rotate.

Here, the second light-coupling lens 64 and second optical fiber 61 form a turnabout optical part. If necessary, this turnabout optical part is further equipped with a transparent window 23, thus further forming a turnabout optical system together with the polished surface 44. The term "turnabout optical system" refers to a system which is devised so that when probe light is incident on a specified position within this turnabout optical system, the above-mentioned reflected signal light is emitted in the opposite direction from this specified position.

The first light-coupling lens 63 focuses the probe light and causes this light to be incident on the first end surface of the first optical fiber 62; furthermore, this lens causes the reflected signal light that is emitted from the first end surface of the first optical fiber 62 to be incident on the beam splitter 25. Here, in order to eliminate light transmission loss, it is desirable that the first light-coupling lens 63 be matched with the mode of the first optical fiber 62. The first optical fiber 62 and second optical fiber 61 transmit the probe light that is incident from the respective first end surfaces of these optical fibers, and cause this light to be emitted from the second end surfaces; furthermore, these optical fibers transmit the reflected signal light that is incident from the second end surfaces, and cause this light to be emitted from the first end surfaces. Furthermore, the second light-coupling lens 64 receives the probe light that is emitted from the second end surface of the first optical fiber 62, and focuses this light so that this light is caused to be incident on the first end surface of the second optical fiber 61; moreover, this second light-coupling lens 64 receives the reflected signal light that is emitted from the first end surface of the second optical fiber 61, and focuses this light so that this light is caused to incident on the second end surface of the first optical fiber 62. Here, in order to eliminate light transmission loss, it is desirable that the second light-coupling lens 64 be matched with the modes of both the first optical fiber 62 and the second optical fiber 61.

The probe light that is emitted from the second end surface of the second optical fiber 61 passes through the transparent window 23 and is caused to illuminate the polished surface of the substrate 42. The reflected signal light that is reflected from this point again passes through the transparent window 23 in the opposite direction, and is incident on the second end surface of the second optical fiber 61.

Thus, even in cases where monitoring is performed in an operating state in which the polishing surface plate of the polishing apparatus is rotating, the first optical fiber 62 can be kept in a non-rotating state; as a result, the light source 24, beam splitter 25, light detector 26 and first light-coupling lens 63, which require installation space, can be installed in non-rotating positions. This reduces the restrictions on the installation space, and is extremely convenient for reducing the size of the polishing apparatus.

Next, the overall construction of the polishing apparatus in the same FIG. 1 will be described. In FIG. 1, 31 indicates a polishing surface plate, 32 indicates a polishing body that is fastened to the polishing surface plate 31, 34 indicates a shaft around which the polishing surface plate 31 rotates, 42 indicates a substrate, 33 indicates a substrate holding part that holds the substrate 42, and 43 indicates a polishing agent supply mechanism.

In polishing, the polished surface of the substrate 42 is pressed against the working surface of the polishing body 32 by a pressure-applying mechanism (not shown in the figures), and the substrate holding part 33 is rotated (only the direction of rotation about the axis of rotation 12 is shown) while a polishing agent 41 is supplied by the polishing agent supply mechanism 43. Furthermore, the polishing surface plate 31 is rotated (the direction of rotation about the axis of rotation 11 is indicated) by a rotary mechanism (not shown in the figures), so that the polished surface of the substrate 42 is polished.

It is desirable that the polishing body 32 be equipped with a transparent window 23. This transparent window 23 has the function of transmitting the probe light and reflected light, and the function of preventing the leakage of the polishing agent. It is desirable that an anti-reflection film be formed on at least one side of this transparent window 23 in order to reduce reflection loss of the transmitted probe light and reflected light at the interface.

When monitoring is to be performed, the probe light that is emitted from the light source 24 passes through the beam splitter 25; this light further passes through the first light-coupling lens 63 and first optical fiber 62, and is emitted toward the second light-coupling lens 64 from the end surface of the first optical fiber 62 which is in a specified position. This probe light further passes through the light-coupling lens 64, the second optical fiber 61 and the transparent window 23, and is emitted toward the polished surface of the substrate 42.

Here, furthermore, an iris 4 is disposed between the beam splitter 25 and the first light-coupling lens 63. By adjusting the aperture of this iris 4, it is possible to adjust the maximum angle of incidence of the probe light that is incident on the first optical fiber 62, and it is also possible to adjust the size of the illuminated spot on the polished surface of the substrate 42.

The reflected signal light from this polished surface follows the above-mentioned path in exactly the opposite direction from the probe light; this reflection passes through the second light-coupling lens 64 and is incident on the end surface of the first optical fiber 62, whose second end surface is placed in a specified position. This light passes through the optical fiber 62. Then, the light passes through the first light-coupling lens 63, and is reflected by the beam splitter 25, so that the light enters the light detector 26 and is detected as a signal. The polishing conditions of the polished surface are monitored according to variations in this reflected signal light.

Here, since the transparent window 23 rotates about the axis of rotation 11, the probe light is caused to illuminate the polished surface of the substrate 42, and a reflected signal is acquired when the transparent window 23 rotates beneath the polished surface.

Since this monitoring device is equipped with a rotary joint 35, the monitoring device can be installed in the rotating part of the polishing apparatus, so that the monitoring device has extremely high all-purpose utility.

[Second Working Configuration]

Figure 2:
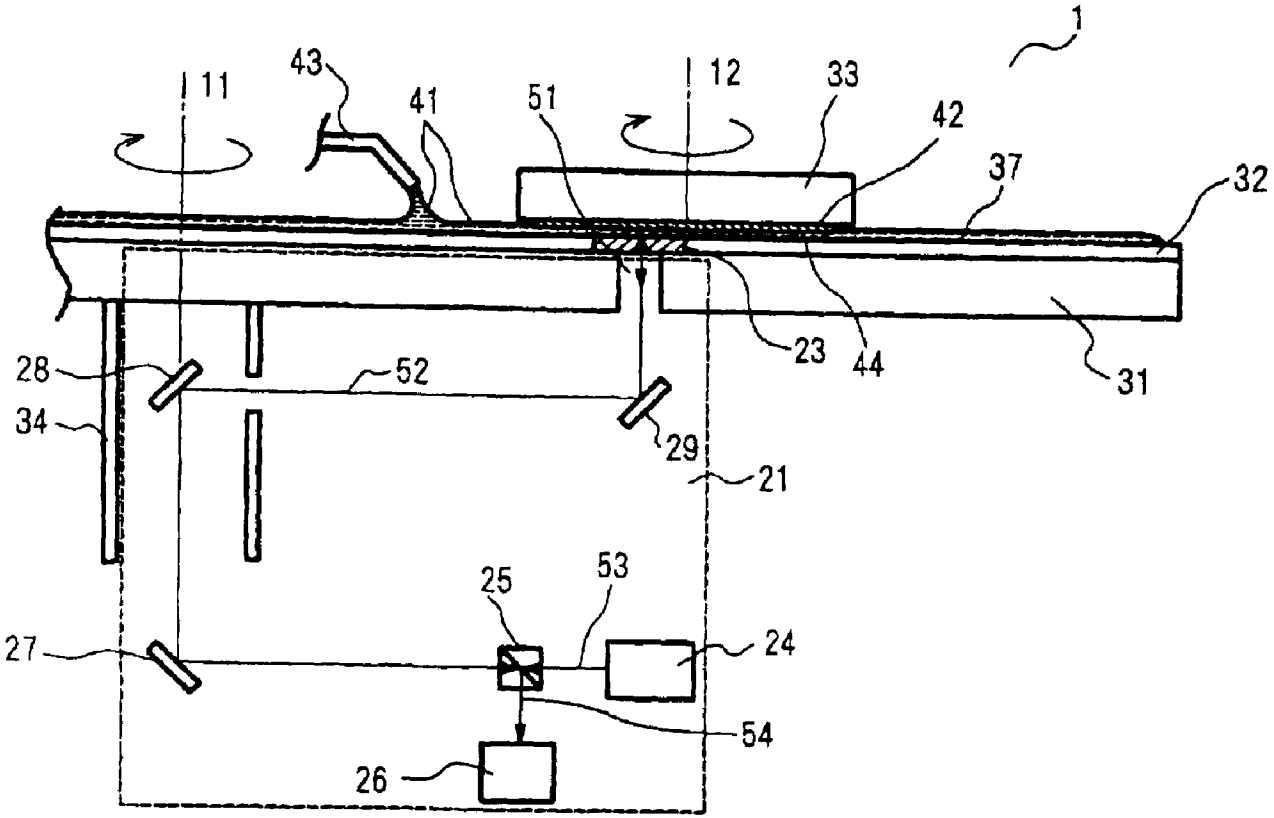
FIG. 2 is a schematic diagram of a monitoring device and polishing apparatus constituting a second working configuration of the present invention.

FIG. 2 shows a schematic diagram of a polishing apparatus incorporating the monitoring device of the present working configuration. The polishing apparatus itself shown in FIG. 2 is identical to the apparatus shown in FIG. 1; accordingly, the same constituent elements are labeled with the same symbols, and a description of the operation is omitted.

In FIG. 2, 21 indicates the monitoring device, which is equipped with a light source 24 that emits probe light, a beam splitter 25, a light detector 26 that receives the reflected signal light, a first reflective mirror 27, a second reflective mirror 28 and a third reflective mirror 29. The position on this first reflective mirror 27 from which the probe light is reflected is adjusted so that this position coincides with the specified position for the incidence of the reflected signal light; and is further adjusted so that the reflected probe light coincides with the axis of rotation 11.

Here, the second reflective mirror 28 and third reflective mirror 29 form a turnabout optical part. If necessary, this turnabout optical part is further equipped with a transparent window 23, and further forms a turnabout optical system together with the polished surface 44.

The first reflective mirror 27 emits the probe light emitted from the beam splitter 25 toward the second reflective mirror 28, and emits the reflected signal light emitted from the second reflective mirror 28 toward the beam splitter 25. The second reflective mirror 28 emits the probe light emitted from the first reflective mirror 27 toward the third reflective mirror 29, and emits the reflected signal light that is reflected and emitted from the third reflective mirror 29 toward the first reflective mirror 27. The probe light that is emitted from the third reflective mirror 29 passes through the transparent window 23 and is caused to illuminate the polished surface of the substrate 42. The reflected signal light from this point again passes through the transparent window 23 in the opposite direction, strikes the third reflective mirror and is reflected toward the second reflective mirror 28. Then, this light is reflected by the beam splitter 25 (via the first reflective mirror 27), and is incident on the light detector 26, so that this light is detected as a signal. The polishing conditions of the polished surface are monitored according to variations in this reflected signal light.

Thus, as in the above-mentioned first working configuration, even in cases where monitoring is performed in an operating state in which the polishing surface plate of the polishing apparatus is rotating, the first reflective mirror 27, light source 24, beam splitter 25 and light detector 26 can be installed in non-rotating positions, which is extremely convenient for reducing the size of the polishing apparatus.

The second reflective mirror 28 is built into the interior of the shaft 34, and is arranged so that this second reflective mirror 28 rotates together with the shaft 34. The rotating second reflective mirror 28 receives the probe light that is reflected from the non-rotating first reflective mirror 27 while this second reflective mirror 28 rotates, and emits this probe light toward the third reflective mirror 29, which rotates at the same angular velocity as the second reflective mirror 28. Similarly, furthermore, the rotating second reflective mirror 28 receives (while rotating) the reflected signal light emitted from the third reflective mirror 29 rotating at the same angular velocity as the second reflective mirror 28, and emits this reflected signal light toward the non-rotating first reflective mirror 27.

When monitoring is to be performed, the probe light emitted from the light source 24 passes through the beam splitter 25, and is emitted toward the polished surface of the substrate 42 via the first reflective mirror 27 (which is disposed in a specified position), second reflective mirror 28, third reflective mirror 29 and transparent window 23. The reflected signal light from this polished surface follows the above-mentioned path in exactly the opposite direction from the probe light; this reflected signal light is reflected by the first reflective mirror 27 (which is disposed in a specified position), and is then reflected by the beam splitter 25, so that this light enters the light detector 26 and is detected. The polishing conditions of the polished surface are monitored according to variations in this reflected signal light.

Here, since the transparent window 23 rotates together with the second reflective mirror 28 and third reflective mirror 29 about the axis of rotation 11, the probe light is caused to illuminate the polished surface of the substrate 42, and a reflected signal is acquired when the transparent window 23 rotates beneath the polished surface.

[Third Working Configuration]

The present working configuration differs from the first working configuration only in that the end surface of the second optical fiber 61 is bonded to the transparent window 23 using an adhesive agent.

In the first working configuration shown in the schematic diagram of FIG. 1, the probe light emitted from the second optical fiber 61 is caused to illuminate the polished surface of the substrate 42 directly, and the reflected signal light is again caused to be incident on the end surface of the second optical fiber 61. However, the probe light that is emitted from the second optical fiber 61 is divergent light; furthermore, there is a gap between the transparent window and the end surface of the optical fiber, so that the distance between these two parts cannot be ignored. Accordingly, since a considerable amount of the reflected signal light is lost due to divergence, the quantity of light that is incident on the second optical fiber 61 is reduced.

Figure 3:
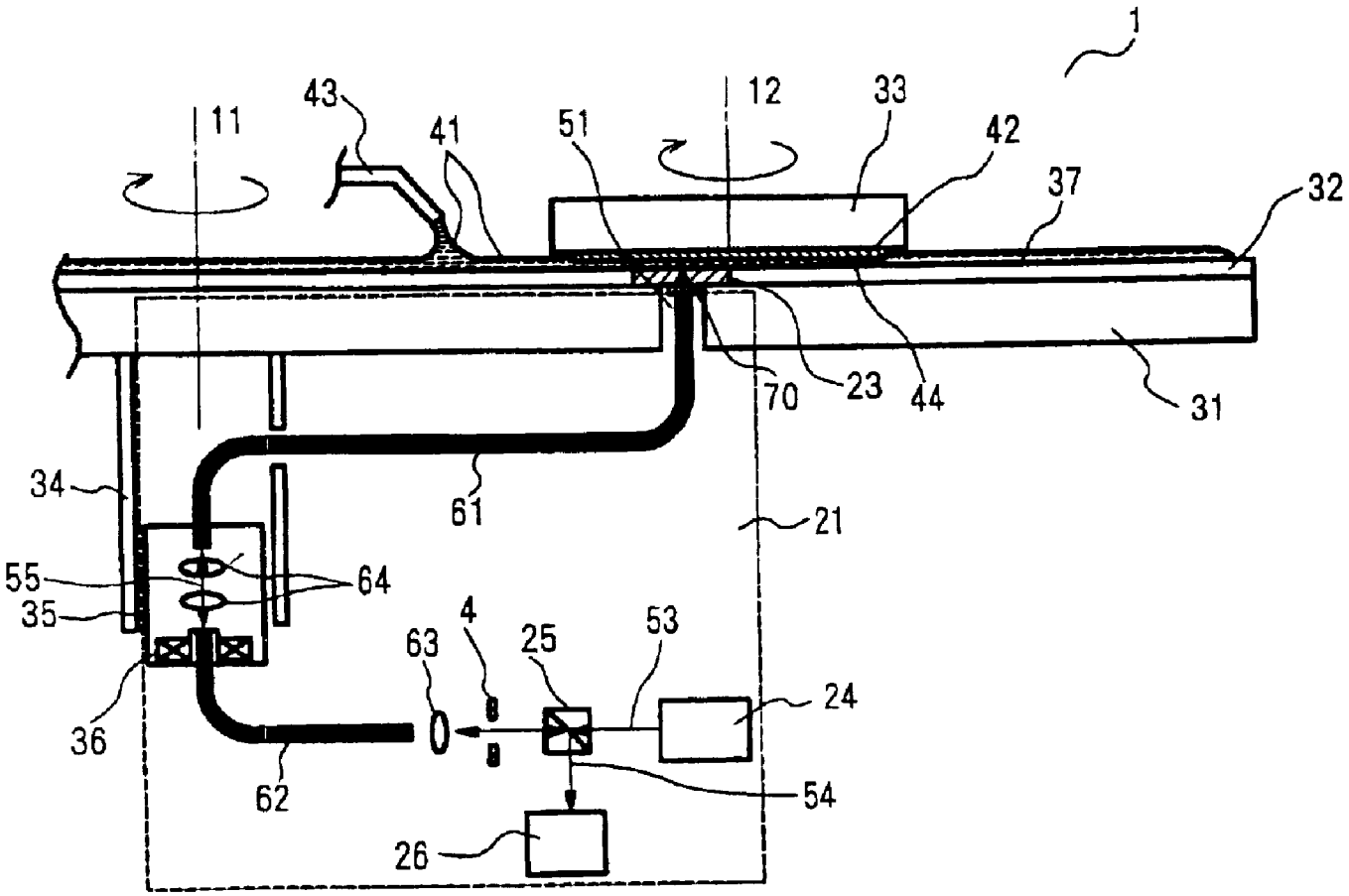
FIG. 3 is a schematic diagram of a monitoring device and polishing apparatus constituting third and fourth working configurations of the present invention.

In the present working configuration, as a countermeasure, the end surface of the second optical fiber 61 is bonded to the transparent window 23 using an adhesive agent. Specifically, the end surface of the second optical fiber 61 and the transparent window 23 are bonded using an adhesive agent 70 which has a refractive index that is within the range of $n_0 \pm 17\%$ and within the range of $n_1 \pm 17\%$, where $n_0$ is the refractive index of the end surface of the second optical fiber, and $n_1$ is the refractive index of the transparent window 23. An outline of this working configuration is shown in FIG. 3.

As a result of this arrangement, not only can the end surface of the second optical fiber 61 be moved closer to the polished surface of the substrate 42, but reflection loss at the interface of the transparent window 23 and the end surface of the second optical fiber 61 can be reduced at the same time. A method in which an anti-reflection film is formed on the end surface of the second optical fiber 61 is conceivable in order to reduce the reflection loss at this optical fiber end surface. However, since the end surface of the optical fiber has an extremely small and slender shape, the formation of an anti-reflection film by ordinary vacuum evaporation methods is difficult, and the manufacturing cost in such a case is high. Furthermore, even if the reflection loss at the end surface of the optical fiber is reduced, the problem of reflection loss at the surface of the transparent window remains. In contrast, the bonding method of the present working configuration is also superior from the standpoint of cost.

The reflectivity R at the interface between transparent objects with different refractive indices n and n' is generally given by the following equation:

$$R=\{(n-n')/(n+n')\}^2$$

Assuming that n=1.5, then the reflectivity of the interface with air, which has a refractive index n' of 1.0, is approximately 4%. However, as this interfacial difference in refractive indices decreases, the reflectivity of the interface drops. In a case where the end surface of the optical fiber 61 and the transparent window 23 are bonded by means of an adhesive agent which has a refractive index with a difference of 17% or less relative to $n_0$, and which also has a refractive index with a difference of 17% or less relative to $n_1$, not only the reflectivity at the interface between the optical fiber and the adhesive agent, but also the reflectivity at the interface between the adhesive agent and the transparent window 23, can be reduced to approximately 1% or less. As a result, the reflected signal light can be increased.

[Fourth Working Configuration]

The present working configuration differs from the third working configuration only in that an anti-reflection film used to reduce the reflectivity at the interface between the adhesive agent and the transparent window is formed on the surface of the transparent window 23.

In the third working configuration, the end surface of the second optical fiber 61 and the transparent window 23 are bonded using an adhesive agent 70 which has a refractive index that is within the range of $n_0 \pm 17\%$ and within the range of $n_1 \pm 17\%$, where $n_0$ is the refractive index of the end surface of the second optical fiber, and $n_1$ is the refractive index of the transparent window 23. However, depending on the values of $n_0$ and $n_1$, there may be cases in which an appropriate adhesive agent that satisfies the refractive index condition of $n_1 \pm 17\%$ cannot be found. In such cases, an anti-reflection film which is used to reduce reflection at the interface between the adhesive agent and the transparent window is formed on the surface of the transparent window 23. In the present working configuration, an anti-reflection film (not shown in the figures) is formed on the surface of the transparent window 23 in the third working configuration shown in FIG. 3.

As a result of such an arrangement, the degree of freedom in the selection of adhesive agents can be increased, and the reflectivity at the two interfaces with the adhesive agent can be sufficiently reduced; consequently, the reflected signal light can be increased.

[Fifth Working Configuration]

Figure 4:
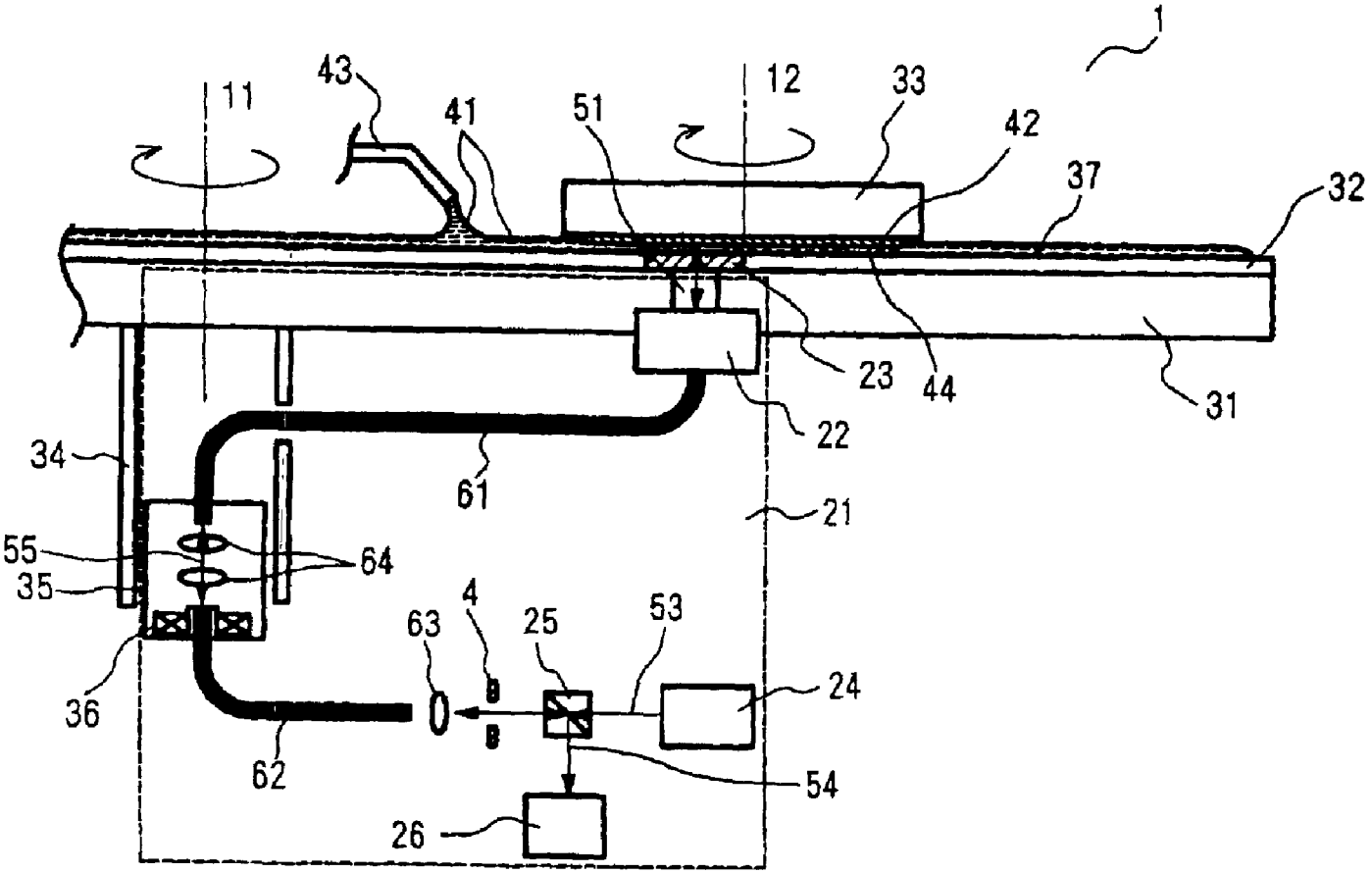
FIG. 4 is a schematic diagram of a monitoring device and polishing apparatus constituting a fifth working configuration of the present invention.
Figure 5:
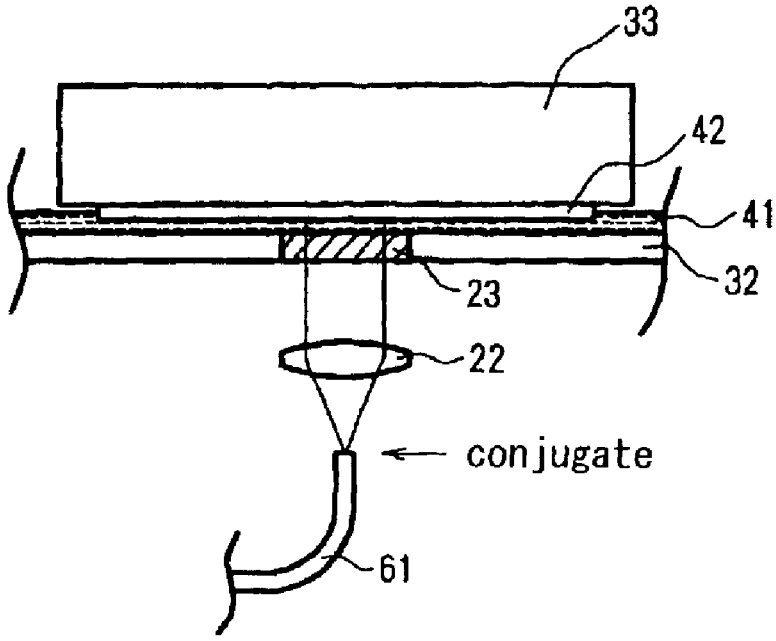
FIG. 5 is a schematic diagram of the vicinity of the optical system which has a convex power in the monitoring device of the fifth working configuration of the present invention.

An overall schematic diagram of the present working configuration is shown in FIG. 4, and the optical system in the vicinity of the optical window is shown in FIG. 5. This working configuration differs from the first working configuration only in that an optical system 22 which has a convex power is disposed between the end surface of the second optical fiber and the transparent window. The optical system 22 may also be constructed from a plurality of lenses; in these figures, however, only a single lens is shown in representative terms.

The reflection loss at the end surface of the second optical fiber 61 and the surface of the transparent window 23 can be reduced by means of the third and fourth working configurations; however, as was described in the third working configuration, the probe light emitted from the second optical fiber is divergent light, and the transparent window 23 has a thickness that cannot be ignored; accordingly, while the probe light and reflected signal light travel over this distance, the light diverges, so that only a portion of the light can enter the end surface of the second optical fiber 61.

In FIG. 5, the optical system 22 that has this convex power is designed so that the position of the end surface of the second optical fiber 61 is again optically conjugate with respect to the polished surface of the substrate 42. In other words, the probe light emitted from the end surface of the second optical fiber 61 is refracted by the optical system 22 having a convex power, and is caused to illuminate the polished surface, and the reflected signal light is again refracted in the opposite direction by the optical system 22 having a convex power. As a result, an equal-size image of the shape of the end surface at the time of emission is focused on the end surface position of the second optical fiber 61.

Furthermore, it is desirable that this optical system 22 having a convex power be devised so that the mode is matched with respect to the incidence on and emission from the second optical fiber 61, thus preventing light loss. If this is done, then all of the signal light reflected by the polished surface can in principle be taken into the second optical fiber 61. As a result, the reflected signal light can be increased.

[Sixth Working Configuration]

Figure 6:
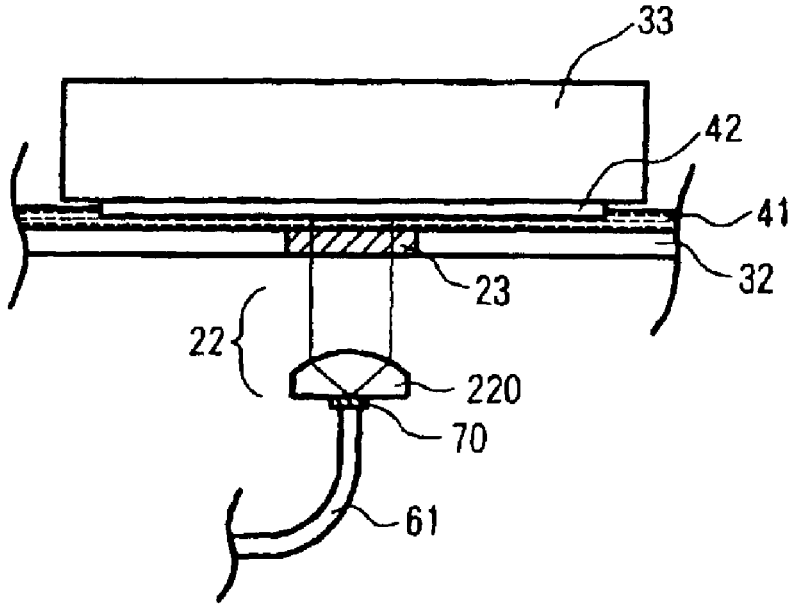
FIG. 6 is a schematic diagram of the vicinity of the optical system which has a convex power in monitoring devices constituting sixth and seventh working configurations of the present invention.

FIG. 6 shows an outline of the optical system of the area in the vicinity of the optical window of the present working configuration. This working configuration differs from the fifth working configuration only in that the lens 220 (which is the closest part of the optical system 22 to the end surface of the second optical fiber) and the end surface of the second optical fiber are bonded by means of an adhesive agent 70. There may be cases in which the optical system 22 is constructed using a plurality of lenses; however, in FIG. 6, only a single lens is shown as a representative example in such cases as well. Here, as in the third working configuration, refractive index conditions are required, and it is desirable that the end surface of the second optical fiber 61 and the lens 220 be bonded by an adhesive agent 70 which has a refractive index that is within the range of $n_0 \pm 17\%$ and within the range of $n_2 \pm 17\%$, where $n_0$ is the refractive index of the end surface of the second optical fiber, and $n_2$ is the refractive index of the lens 220.

As a result of such an arrangement, the interfacial reflection at the end surface of the second optical fiber 61 and the reflection of light by the interface on the bonded surface side of the lens 220 can be reduced; consequently, the reflected signal light can be increased.

[Seventh Working Configuration]

This working configuration differs from the sixth working configuration only in that an anti-reflection film which is used to reduce the reflection at the interface between the adhesive agent and the lens 220 is formed on the surface of the lens 220. Specifically, in FIG. 6, an anti-reflection film (not shown in the figures) is formed on the surface of the lens 220.

In the sixth working configuration, the end surface of the second optical fiber 61 and the lens 220 are bonded by means of an adhesive agent 70 which has a refractive index that is within the range of $n_0 \pm 17\%$ and also within the range of $n_2 \pm 17\%$, where $n_0$ is the refractive index of the end surface of the second optical fiber, and $n_2$ is the refractive index of the lens 220. However, depending on the values of $n_0$ and $n_2$, there may be cases in which an appropriate adhesive agent that satisfies the refractive index condition of $n_2 \pm 17\%$ cannot be found. In such cases, an anti-reflection film which is used to reduce reflection at the interface between the adhesive agent 70 and the lens 220 is formed on the surface of the lens 220.

As a result of such an arrangement, the degree of freedom in the selection of adhesive agents can be increased, and the reflectivity at the two interfaces with the adhesive agent can be sufficiently reduced; consequently, the reflected signal light can be increased.

[Eighth Working Configuration]

Figure 7:
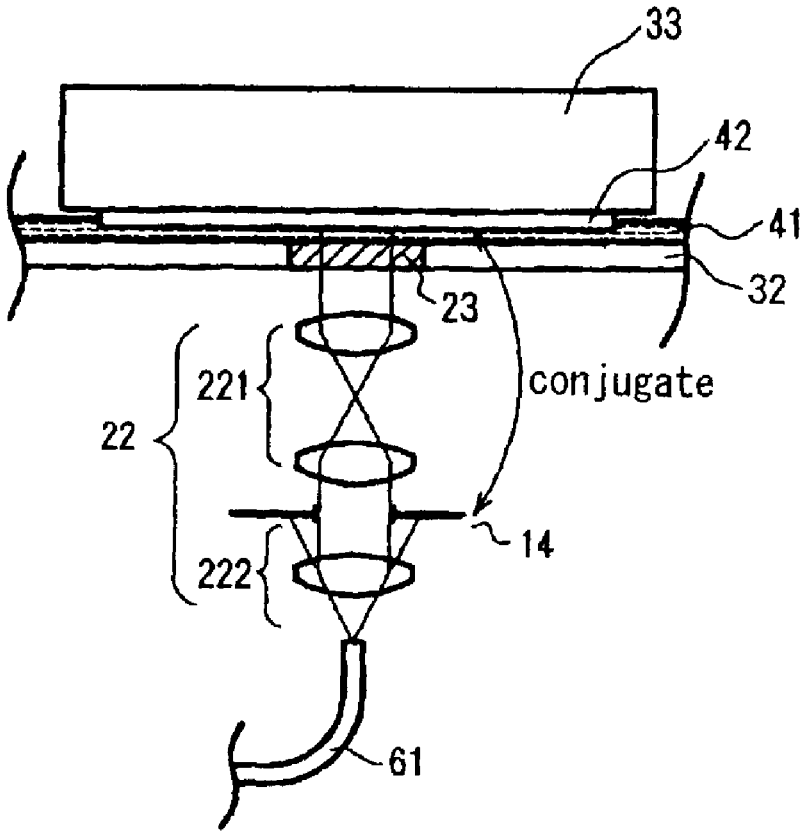
FIG. 7 is a schematic diagram of the vicinity of the optical system which has a convex power in a monitoring device constituting an eighth working configuration of the present invention.

The conditions in the vicinity of the optical system 22 of this working configuration are shown in FIG. 7. This working configuration differs from the fifth working configuration only in that the optical system 22 is further developed. In FIG. 7, the optical system 22 is equipped with a front-group optical system 221 and a rear-group optical system 222, and is further equipped with an iris 14. The iris 14 is installed in the front-group optical system 221 in a position that is optically conjugate with the polished surface of the substrate 42.

The direction in which light is emitted from the second optical fiber 61 may vary if there is a bend, etc., in the optical fiber. Consequently, in the case of the monitoring device of the fifth working configuration, the position illuminated by the light may undergo a shift, etc., thus causing measurement error. The iris 14 installed in the optical system 22 is installed in order to adjust the light beam from the second optical fiber 61. For this reason, the size of the aperture part of the iris 14 is set so that this size is slightly smaller than the size of the light beam emitted from the optical fiber 61.

As a result of such an arrangement, the direction and size of the light beam that passes through this iris 14 can be stabilized even if there is some variation in the direction of the light beam of the probe light that is emitted from the second optical fiber 61. Accordingly, the position on the polished surface of the substrate 42 that is illuminated by the probe light can be fixed along with the illumination range. Furthermore, the shape and dimensions of the illuminated spot on the polished surface can be adjusted by varying the shape and dimensions of this iris. Accordingly, the shape and dimensions of the illuminated spot can be matched to the pattern of the semiconductor device that is the object of measurement. Furthermore, if such an iris 14 is installed, the iris 4 shown in FIGS. 1, 3 and 4 may be omitted.

Furthermore, it is desirable that this working configuration be combined with the sixth or seventh working configuration.

In this working configuration, all of the signal light reflected by the polished surface is received by the optical system 22, and is taken into the second optical fiber 61; as a result, not only can the reflected signal light be increased, but the position on the polished surface of the substrate 42 that is illuminated by the probe light can be fixed, along with the dimensions of this illuminated position. Accordingly, measurements can be performed with good precision, and diverse semiconductor device patterns can be handled by adjusting the dimensions of the iris 14.

[Ninth Working Configuration]

Figure 8:
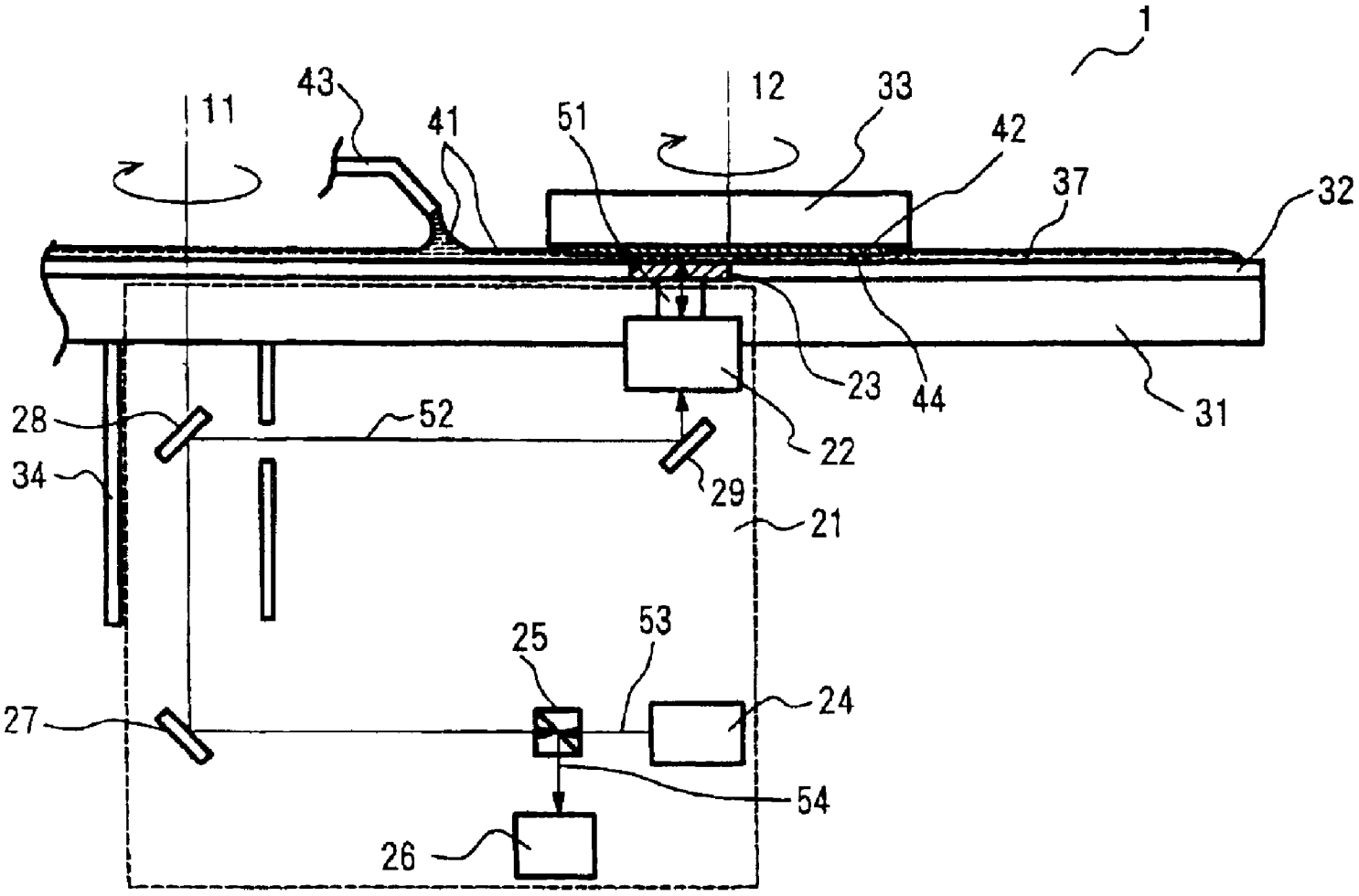
FIG. 8 is a schematic diagram of the vicinity of the optical system which has a convex power in a monitoring device constituting a ninth working configuration of the present invention.

A schematic diagram of this working configuration is shown in FIG. 8. This working configuration differs from the second working configuration only in that an optical system 22 which has a convex power is disposed between the third reflective mirror 29 and the transparent window 23. The optical system 22 may also be constructed from a plurality of lenses; in this figure, however, this optical system is simply indicated by a square block. In the second working configuration, the probe light emitted from the light source 24 may diverge before reaching the polished surface of the substrate 42, so that the polished surface cannot be illuminated with a spot of the required size. Accordingly, the light is stopped down to a spot of the desired size by means of this optical system 22 with a convex power.

If necessary, furthermore, a relay optical system may be separately installed between the first reflective mirror and the second reflective mirror, or between the second reflective mirror and the third reflective mirror. In this way, it is possible not only to handle diverse semiconductor device patterns, but also to prevent the reflected signal light from straying from the light path of the optical system, so that the light can be received by the light detector 26 without any waste.

In this way, the beam splitter 25, light source 24, optical system including a spectroscope (in cases where a spectroscopic reflected signal is detected), and light detector, which require a relatively large installation space, can be installed separately from the polishing apparatus. Furthermore, on the side of the polishing apparatus, it is necessary to install only a compact turnabout optical part equipped with optical fibers, reflective mirrors or lenses, etc., used to achieve the stable transmission of the probe light and illumination of the polished surface with this probe light, and also used for the stable reception of the reflected signal light and the stable transmission of this light to a specified position on the axis of rotation. Accordingly, if this monitoring device is used in a polishing apparatus, the polishing conditions can be monitored with a high degree of precision without increasing the size of the polishing apparatus. Furthermore, this monitoring method also makes it possible to monitor the polishing conditions with a high degree of precision without increasing the size of the polishing apparatus. Moreover, the polishing apparatus into which this monitoring device is incorporated is compact and light-weight, and can monitor the polishing conditions with a high degree of precision. If this polishing apparatus is used to polish semiconductor wafers on which semiconductor elements are formed, semiconductor wafers can be obtained in which the polishing conditions are monitored with a high degree of precision.

[Tenth Working Configuration]

In the first, third, fourth, fifth, sixth, seventh and eighth working configurations, the reflection of light at the end surfaces of the optical fibers was sometimes a problem. For example, in the first working configuration, the reflected probe light that is reflected by the first end surface and second end surface of the first optical fiber, and by the first end surface and second end surface of the second optical fiber, is propagated in the opposite direction from the direction of the substrate 42, and may enter the light detector as noise light (flare light).

Assuming that the refractive index of the cores of the first and second optical fibers is 1.45, and that the refractive index of the outer parts of these optical fibers is 1.00, then the reflectivity at the respective end surfaces is approximately 3.4%. Since the intensity of the probe light and reflected signal light may drop greatly as a result of scattering loss caused by the polishing agent 41 and loss during propagation by other optical systems, or as a result of the low reflectivity characteristics of certain types of wafers, the intensity of the reflected signal light that finally enters the light detector 26 may be greatly reduced from the intensity of the probe light in the stage of propagation through the optical fibers. Accordingly, a reflectivity of 4% is a value that cannot be ignored.

Since this noise light causes a drop in the S/N ratio of the signal, such noise light may cause a deterioration in the measurement precision of the measurement of the polishing conditions, such as the measurement of the residual film thickness and the detection of the polishing endpoint.

The present working configuration was devised in order to solve the above-mentioned problems, and is a modification of the first, third, fourth, fifth, sixth, seventh and eighth working configurations. The difference of the present working configuration from these working configurations lies in the orientation of the end surfaces of the optical fibers. In the first working configuration, there was no stipulation regarding the orientation of the end surfaces of the optical fibers with respect to the direction of the optical axis of the optical fibers. In the present working configuration, the normal directions of the end surfaces of the optical fibers are set so that these normal directions are not parallel to the directions of the optical axes of the optical fibers. Especially in cases where the end surfaces are not bonded, it is desirable that the normal directions of these end surfaces be set so that these normal directions are not perpendicular to the axial directions of the optical fibers.

Figure 9:
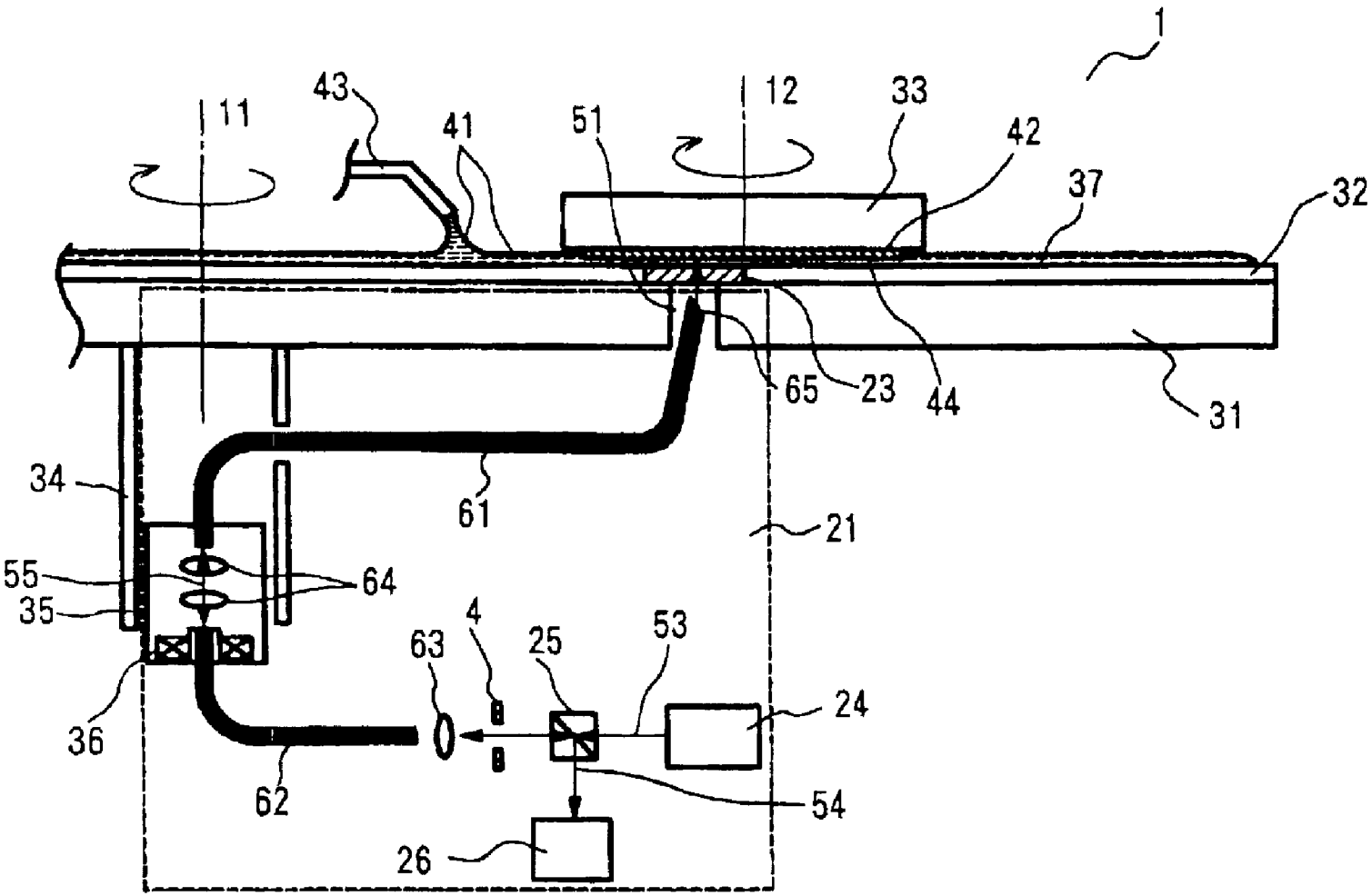
FIG. 9 is a schematic diagram of a monitoring device and polishing apparatus constituting a tenth working configuration of the present invention.
Figure 10:
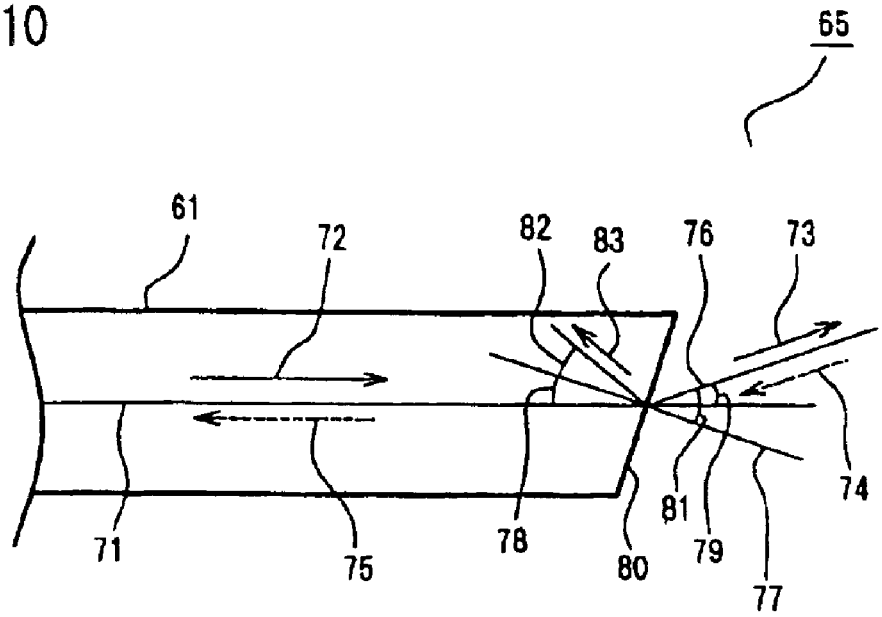
FIG. 10 is an enlarged view of the wedge-form end portion of the optical fiber.
Figure 11:
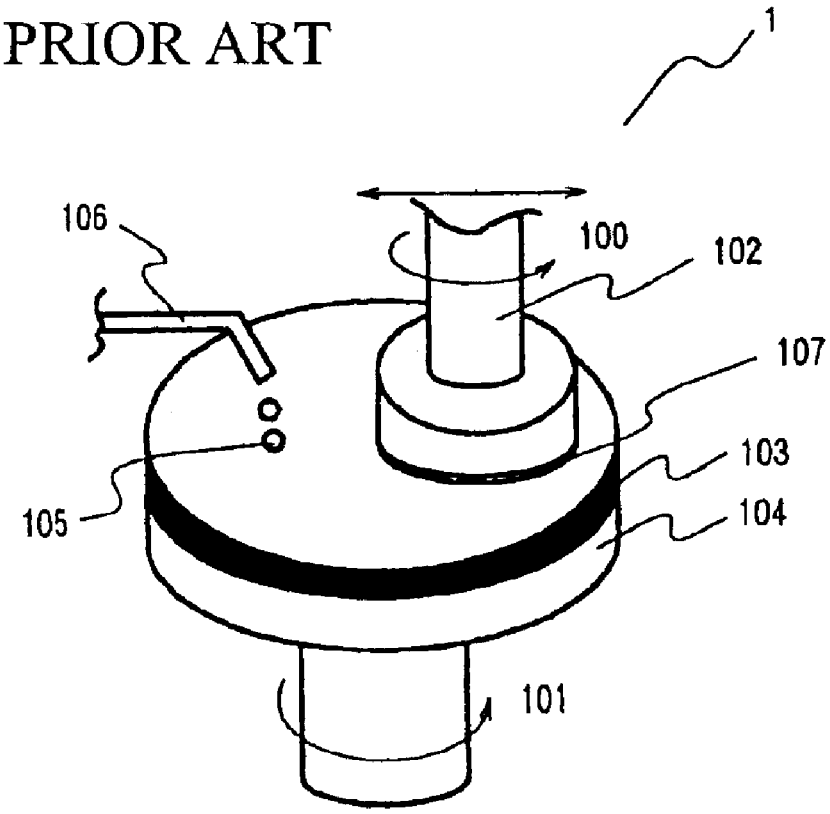
Fig. 11 PRIOR ART
FIG. 11 is a schematic diagram of a CMP polishing apparatus.
Figure 12:
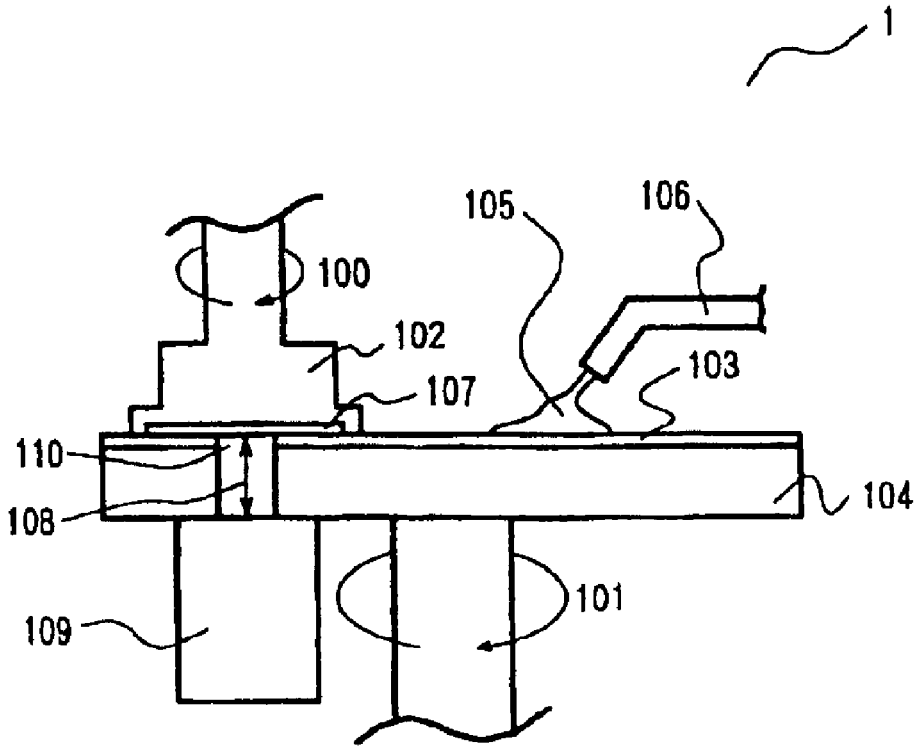
Fig. 12 PRIOR ART
FIG. 12 is a schematic diagram which shows the relationship of a conventional monitoring device and polishing apparatus.

FIGS. 9 and 10 are schematic diagrams of one example of the present working configuration. FIG. 9 differs from the working configuration shown in FIG. 1 only in that the end portion 65 of the second optical fiber 61 in FIG. 1 (which illustrates the first working configuration) is formed with a wedge shape, and in this end portion 65, the axis of the second optical fiber is set so that this axis is not parallel to the normal direction of the substrate.

FIG. 10 is an enlarged view of the end portion 65 of the second optical fiber 61 shown in FIG. 9. 61 indicates the second optical fiber, and 71 indicates the axis of this optical fiber; the probe light and reflected signal light are propagated along this axis. 72 indicates the direction of propagation of the probe light, and 75 indicates the direction of propagation of the reflected signal light. 76 indicates the optical axis of the emitted probe light that is emitted from the second optical fiber 61 and the reflected signal light that is incident on the second optical fiber 61. 73 indicates the direction of propagation of the emitted probe light, and 74 indicates the direction of propagation of the reflected signal light. 77 indicates the normal direction of the second end surface 80, and 78 indicates the angle of inclination (wedge angle) of the end surface; this is the angle formed by the axis 71 of the optical fiber and the normal direction 77 of the second end surface 80.

In a case of a quartz fiber in which the refractive index of the core is 1.45, the angle of inclination 78 is set at 8 degrees. Since this angle is also equal to the angle of incidence of the probe light on the second end surface 80, this angle is sometimes also called the "angle of incidence." Furthermore, since this angle is also equal to the angle of refraction of the reflected signal light with respect to the second end surface, this angle is sometimes also called the "angle of refraction." 81 is the angle corresponding to the angle of refraction when the emitted probe light is emitted, and is an angle of 11.6 degrees. Furthermore, 82 is the angle of reflection when the probe light is reflected by the second end surface 80, and is equal to the angle of incidence 78. 83 is the direction of the reflected probe light.

The description of the probe light up to the point where the probe light reaches the second optical fiber is the same as in the case of the first working configuration; accordingly, this description is omitted here. The probe light that is propagated in the direction 72 along the axis 71 of the second optical fiber 61 is incident on the second end surface 80 at the angle of incidence 78; this light is refracted by the angle of refraction 81 and emitted; furthermore, a portion of the probe light is reflected at the angle of reflection 82. The refracted probe light is propagated in the direction 73, and is incident on the polished surface of the substrate 42.

Since the direction 73 and the normal direction of the polished surface are adjusted so that these directions are perpendicular to each other, the reflected signal light that is reflected from this point is propagated in the direction 74 along the optical axis 76; this light is incident on the second optical fiber at the second end surface 80 at the angle of incidence 81 and angle of refraction 78, and is propagated in the direction 75 along the axis 71. Furthermore, the reflected probe light that is reflected in the direction 83 is inclined by the large angle of 16 degrees with respect to the axis 71 of the optical fiber; accordingly, this light does not form the propagation mode of this second optical fiber, but is radiated and lost during propagation through the second optical fiber 61. The subsequent travel of the reflected signal light is the same as in the first working configuration; accordingly, a description of this is omitted. In this way, the reflected signal light enters the light detector 26, and is detected as a signal. The polishing conditions of the polished surface are monitored according to variations in this reflected signal light.

In this working configuration, the reflected light of the probe light that is reflected by the second end surface 80 of the second optical fiber does not enter the light detector 26; accordingly, the S/N ratio of the reflected signal light can be increased, so that the measurement precision of the polishing conditions such as the measurement of the residual film thickness and the detection of the polishing endpoint can be improved compared to the precision obtained in the first working configuration.

In the above description, for the sake of simplicity, a case in which only the second end surface 80 of the second optical fiber 61 was made non-perpendicular with respect to the axis was described as a modification of the first working configuration. The end surface that is thus made non-perpendicular may also be the first end surface of the second optical fiber 61, the first end surface of the first optical fiber 62 or the second end surface of the first optical fiber 62; one or more of these end surfaces may be made non-perpendicular, or all of these end surfaces may be made non-perpendicular.

Generally, the S/N ratio of the signal can be increased as the number of end surfaces that are made non-perpendicular increases, so that the measurement precision of the polishing conditions such as the measurement of the residual film thickness and the detection of the polishing endpoint can be improved. The question of which end surfaces are made non-perpendicular, or how many end surfaces are made non-perpendicular, is determined by striking a bargain among the following factors: namely, the effect in reducing flare light when the respective end surfaces are made non-perpendicular, the required measurement precision, and the additional cost. Furthermore, besides the first working configuration, the present working configuration can also be applied to the third, fourth, fifth, sixth, seventh and eighth working configurations by means of a similar method in which the end surfaces of the optical fibers are made non-perpendicular to the axes of the optical fibers.

In the above description, flare light was reduced by making the end surfaces of the optical fibers non-perpendicular to the axes of the optical fibers. However, a similar effect can also be obtained by forming anti-reflection films on the respective end surfaces as a modification of the tenth working configuration, without particularly making the end surfaces non-perpendicular to the axes of the optical fibers. A portion of this example has already been disclosed in the previous working configurations. In such a case, because of the residual reflected light of the anti-reflection films, the flare light cannot be completely reduced to zero. Accordingly, the effect is not as great as in a case where the end portions are formed with a wedge shape; however, such a method may be used if necessary in cases where there are restrictions on the disposition of the optical parts, etc.

[Eleventh Working Configuration]

This working configuration differs from the first, third, fourth, fifth, sixth, seventh, eighth and tenth working configurations only in that optical fibers equipped with cores consisting of a liquid are used as the optical fibers 61 and 62. The optical fibers used in the present working configuration are constructed by injecting a liquid as a core material with a refractive index that is higher than that of the cladding material into a cylindrical cladding material consisting of a flexible transparent resin, etc.; these optical fibers are extremely superior in terms of flexibility. Furthermore, the ratio of the area of the core part to the cross-sectional area of the optical fiber is higher than in the case of bundled fibers in which a plurality of fine optical fibers are formed into a bundle; accordingly, the transmissivity is higher than that of bundled fibers.

Furthermore, since the degree of freedom in the selection of the materials for the cladding material and core material is high, the difference in refractive index between the cladding material and core material can be made greater than in bundled fibers; as a result, an NA that is much higher than that of bundled fibers can be obtained. It is desirable that Liquid Light Guides manufactured by Pneum K.K. be used as the optical fibers of the present working configuration.

In the present working configuration, the flexibility of the optical fibers is extremely high, so that the optical fibers will not break even if bent at a small curvature radius. Accordingly, the degree of freedom in incorporating the optical fibers into the polishing body parts is high, and as a result, the monitoring device or polishing apparatus can be made more compact. Furthermore, since the light transmissivity of the optical fibers is high, the same reflected signal light can be obtained using a compact light source with a low radiant light intensity, so that the monitoring device can be made more compact. Moreover, since the optical fibers have a high NA, high-efficiency light coupling can easily be realized, so that the degree of freedom in the design of the optical system is high.

In the first through eleventh working configurations described above, cases were described in which the constituent elements of the monitoring device were divided into rotating members and non-rotating members. However, it goes without saying that the monitoring device of the present invention could also be constructed using only non-rotating members. In this case, the other rotating members constitute the polishing apparatus.

Furthermore, in all of the first through eleventh working configurations described above, measurement of the residual film thickness or detection of the process endpoint is performed in order to monitor the polishing conditions. Preferably, furthermore, spectroscopic reflected signal light is detected as the reflected signal light, and a spectroscope (not shown in the figures) is disposed in front of the light detector 26 for this purpose. The results of this spectroscopic measurement are sent to a signal processing part (not shown in the figures) by an A/D converter, etc. (not shown in the figures), and the film thickness can be calculated here. In concrete terms, in order to detect variations in the spectroscopic reflected signal with a high degree of precision, it is desirable to use parameters calculated from the spectroscopic reflected signal, or to perform a comparison between reference values of the spectroscopic reflection characteristics and the measured values of the spectroscopic reflection characteristics using cross-correlation functions, etc.

Furthermore, the light source 24 of the monitoring device is preferably equipped with a n iris (not shown in the figures) used to control the spatial coherence length, so that the degree of pattern interference can be controlled in accordance with the pattern dimensions of the polished surface. Moreover, an iris (not shown in the figures) is preferably disposed in front of the light detector 26 in order to exclude first-order or higher diffraction components and detect only zero-order light as the spectroscopic reflected signal. Such spatial coherence length control techniques and zero-order light extraction techniques are disclosed in Japanese Patent Application Kokai No. 2000-40680, Japanese Patent Application Kokai No. 2000-241126, Japanese Patent Application Kokai No. 2000-186917 and Japanese Patent Application Kokai No. 2000-186918.

Furthermore, it is desirable that the monitoring device of the present invention be covered by a pipe, etc., whose interior is coated with a matte light-absorbing coating material, etc., so that no harmful external light enters the light path (e.g., the light path 52, optical system 22 or measuring parts, etc.) and has a deleterious effect on measurements.

Thus, the optical system of the present monitoring device is divided into a static part and a rotating part that is fastened to the rotating polishing surface plate 31 and shaft 34. The static part and rotating part are light-coupled. Here, the term "light coupling" refers to the fact that light emitted from the static part of the optical system is transmitted to the rotating part without any light loss, and light emitted from the rotating part is transmitted to the static part without any light loss.

Thus, the beam splitter 25, light source 24, optical system including a spectroscope (in cases where a spectroscopic reflected signal is detected), and light detector, which require a relatively large installation space, can be installed separately from the polishing apparatus. Furthermore, on the side of the polishing apparatus, it is necessary to install only a compact turnabout optical part equipped with optical fibers, reflective mirrors or lenses, etc., used to achieve the stable transmission of the probe light and illumination of the polished surface with this probe light, and also used for the stable reception of the reflected signal light and the stable transmission of this light to a specified position on the axis of rotation. Accordingly, if this monitoring device is used in a polishing apparatus, the polishing conditions can be monitored with a high degree of precision without increasing the size of the polishing apparatus. Furthermore, this monitoring method also makes it possible to monitor the polishing conditions with a high degree of precision without increasing the size of the polishing apparatus. Moreover, the polishing apparatus into which this monitoring device is incorporated is compact and light-weight, and can monitor the polishing conditions with a high degree of precision. If this polishing apparatus is used to polish semiconductor wafers on which semiconductor elements are formed, semiconductor wafers can be obtained in which the polishing conditions are monitored with a high degree of precision.

INDUSTRIAL APPLICABILITY

The monitoring device and monitoring method of the present invention can be used to monitor the polishing conditions mainly in a CMP polishing apparatus. Furthermore, the polishing apparatus of the present invention is suitable for use in the polishing of wafers that have semiconductor circuits. Moreover, the semiconductor wafer manufacturing method of the present invention is suitable for use in the manufacture of semiconductor wafers with a good yield.

What is claimed is:

1. A monitoring device which is equipped with a polishing body part that has a rotatable polishing body with a working surface, and a substrate holding part that holds a substrate, and which monitors the polishing conditions by means of a reflected signal light obtained by illuminating the polished surface of the substrate with probe light when the polished surface is polished by interposing a polishing agent between the rotating working surface and the polished surface, and producing a relative motion between these two parts, the monitoring device being characterized by the fact that the device is equipped with a non-rotating light source which emits the probe light, a non-rotating light detector which receives the reflected signal light, and a turnabout optical part which emits the reflected signal light from a specified position on the axis of rotation of the polishing body part when the probe light is incident on this specified position, and which is incorporated into the polishing body part, so that the optical part can rotate together with the polishing body, wherein the turnabout optical part is equipped with a light-coupling lens and a second optical fiber with a refractive index of $n_0$, and the monitoring device is further equipped with a non-rotating first optical fiber.

2. The monitoring device claimed in claim 1, wherein the turnabout optical part is equipped with a transparent window having a refractive index of $n_1$ which transmits the probe light toward the polished surface, and which transmits the reflected signal light in the opposite direction, and wherein an end portion of the second optical fiber and the transparent window are bonded by an adhesive agent with a refractive index whose difference from $n_0$ is ±17% or less, and whose difference from $n_1$ is ±17% or less.

3. The monitoring device claimed in claim 1, wherein the turnabout optical part is equipped with a transparent window having a refractive index of $n_1$ which transmits the probe light toward the polished surface, and which transmits the reflected signal light in the opposite direction, and wherein an end portion of the second optical fiber and the transparent window are bonded by an adhesive agent with a refractive index whose difference from $n_0$ is ±17% or less, and an anti-reflection film which is used to reduce interfacial reflection between the adhesive agent and the transparent window is formed on at least the bonded portion of the transparent window.

4. The monitoring device claimed in claim 1, wherein the turnabout optical part is equipped with a transparent window having a refractive index of $n_1$ which transmits the probe light toward the polished surface, and which transmits the reflected signal light in the opposite direction, and wherein the turnabout optical part is further equipped with an optical system which is installed between the transparent window and the end surface of the second optical fiber, and which has a convex power that is used to illuminate the polished surface with probe light that is emitted from the end surface of the second optical fiber, and to focus the reflected signal light on the end surface of the second optical fiber.

5. The monitoring device claimed in claim 4, wherein a lens with a refractive index of $n_2$ which is located closest to an end surface of the second optical fiber in the optical system and the end surface of the second optical fiber are bonded by an adhesive agent with a refractive index whose difference from $n_0$ is ±17% or less, and whose difference from $n_2$ is ±17% or less.

6. The monitoring device claimed in claim 4, wherein a lens with a refractive index of $n_2$ which is located closest to an end surface of the second optical fiber in the optical system and the end surface of the second optical fiber are bonded by an adhesive agent with a refractive index whose difference from $n_0$ is ±17% or less, and an anti-reflection film which is used to reduce interfacial reflection between the adhesive agent and the lens with a refractive index of $n_2$ is formed on at least the bonded portion of the lens with a refractive index of $n_2$.

7. The monitoring device claimed in claim 4, wherein the optical system is equipped with an iris in a position that is optically conjugate with the polished surface.

8. The monitoring device claimed in claim 1, wherein the normal direction of at least one end surface of the first or second optical fiber is set so that this normal direction is not parallel to the direction of the optical axis of the first or second optical fiber.

9. The monitoring device claimed in claim 1, wherein the first or second optical fiber, or both optical fibers, are optical fibers equipped with a core that consists of a liquid.

10. A monitoring device which is equipped with a polishing body part that has a rotatable polishing body with a working surface, and a substrate holding part that holds a substrate, and which monitors the polishing conditions by means of a reflected signal light obtained by illuminating the polished surface of the substrate with probe light when the polished surface is polished by interposing a polishing agent between the rotating working surface and the polished surface, and producing a relative motion between these two parts, the monitoring device being characterized by the fact that the device is equipped with a non-rotating light source which emits the probe light, a non-rotating light detector which receives the reflected signal light, a turnabout optical part which emits the reflected signal light from a specified position on the axis of rotation of the polishing body part when the probe light is incident on this specified position, and which is incorporated into the polishing body part, so that the optical part can rotate together with the polishing body, and a non-rotating first reflective mirror, and the turnabout optical part is equipped with a second reflective mirror and a third reflective mirror.

11. The monitoring device claimed in claim 10, wherein the turnabout optical part is equipped with a transparent window having a refractive index of $n_1$ which transmits the probe light toward the polished surface, and which transmits the reflected signal light in the opposite direction, and wherein the turnabout optical part is further equipped with an optical system which is installed between the transparent window and the third reflective mirror, which has a convex power that is used to illuminate the polished surface with probe light that is emitted from the third reflective mirror, and the relay the reflected signal light to the third reflective mirror.

12. The monitoring device claimed in claim 11, wherein the optical system is equipped with an iris in a position that is optically conjugate with the polished surface.

13. A polishing apparatus including a monitoring device which is equipped with a polishing body part that has a rotatable polishing body with a working surface, and a substrate holding part that holds a substrate, and which monitors the polishing conditions by means of a reflected signal light obtained by illuminating the polished surface of the substrate with probe light when the polished surface is polished by interposing a polishing agent between the rotating working surface and the polished surface, and producing a relative motion between these two parts, the monitoring device being characterized by the fact that the device is equipped with a non-rotating light source which emits the probe light, a non-rotating light detector which receives the reflected signal light, and a turnabout optical part which emits the reflected signal light from a specified position on the axis of rotation of the polishing body part when the probe light is incident on this specified position, and which is incorporated into the polishing body part, so that the optical part can rotate together with the polishing body, wherein the turnabout optical part is equipped with a light-coupling lens and a second optical fiber with a refractive index of $n_0$, and the monitoring device is further equipped with a non-rotating first optical fiber.

14. A polishing apparatus including a monitoring device which is equipped with a polishing body part that has a rotatable polishing body with a working surface, and a substrate holding part that holds a substrate, and which monitors the polishing conditions by means of a reflected signal light obtained by illuminating the polished surface of the substrate with probe light when the polished surface is polished by interposing a polishing agent between the rotating working surface and the polished surface, and producing a relative motion between these two parts, the monitoring device being characterized by the fact that the device is equipped with a non-rotating light source which emits the probe light, a non-rotating light detector which receives the reflected signal light, a turnabout optical part which emits the reflected signal light from a specified position on the axis of rotation of the polishing body part when the probe light is incident on this specified position, and which is incorporated into the polishing body part, so that the optical part can rotate together with the polishing body, wherein a non-rotating first reflective mirror, and the turnabout optical part is equipped with a second reflective mirror and a third reflective mirror.

15. A semiconductor wafer manufacturing method in which a substrate is a semiconductor wafer on which a semiconductor element is formed, including a step in which a surface of the substrate is polished using the polishing apparatus as defined by claim 13 or 14.

* * * * *